US006464521B1

(12) United States Patent
Kurotori et al.

(10) Patent No.: US 6,464,521 B1
(45) Date of Patent: Oct. 15, 2002

(54) CONNECTOR DEVICE HAVING NARROWED PITCHES BETWEEN TERMINAL MEMBERS

(75) Inventors: Fumio Kurotori; Manabu Shimizu, both of Shinagawa (JP)

(73) Assignee: Fujitsu Takamisawa Component Limited, Tokyo ( * ) Notice: Subject to any disclaimer, the term of this patent is extended or adjusted under 35 U.S.C. 154(b) by 0 days.

(21) Appl. No.: 09/702,863

(22) Filed: Nov. 1, 2000

(30) Foreign Application Priority Data

Jan. 25, 2000 (JP) ..... 2000-16093

(51) Int. Cl.[7] ..... H01R 13/15

(52) U.S. Cl. ..... 439/260; 439/630; 439/325

(58) Field of Search ..... 439/630, 636, 439/325, 326, 329, 260, 495, 493

(56) References Cited

U.S. PATENT DOCUMENTS

| | | | | | |
|---|---|---|---|---|---|
| 5,106,311 | A | * | 4/1992 | Yodogawa et al. | 439/329 |
| 5,695,359 | A | * | 12/1997 | Fujikura et al. | 439/495 |
| 5,785,549 | A | * | 7/1998 | Takayasu | 439/495 |
| 5,839,917 | A | * | 11/1998 | Takahashi et al. | 439/495 |
| 5,863,213 | A | * | 1/1999 | Enomoto et al. | 439/326 |
| 6,206,723 | B1 | * | 3/2001 | Kunishi | 439/495 |

* cited by examiner

*Primary Examiner*—Tho D. Ta
(74) *Attorney, Agent, or Firm*—Staas & Halsey LLP

(57) ABSTRACT

A connector device is provided, which device includes a housing including first and second sides opposing each other, first terminal members attached to the first side of the housing, and second terminal members attached to the second side of the housing. Each of the first terminal members and each of the second terminal members are alternately arranged side by side, and the first and second terminal members have respective contact portions for external connection, the contact portions being arranged side by side.

15 Claims, 13 Drawing Sheets

$$P_2 = \frac{P_3}{2}$$

$$t_{10} > t_1$$

$$t_{11} < t_1$$

$$P_2 < P_1$$

CONNECTOR DEVICE HAVING NARROWED PITCHES BETWEEN TERMINAL MEMBERS

BACKGROUND OF THE INVENTION

1. Field of the Invention

The present invention relates to connector devices, and more particularly to a card edge connector device into which a card edge having a plurality of terminals arranged in a row thereon is inserted to be connected thereto.

A common card edge connector device includes a housing formed of a synthetic resin and a plurality of terminal members fixedly inserted side by side in a row into the housing, and is provided to, for example, the input section of an information device. As an amount of information processed by an information device increases, there is a greater need for the card edge connector device to include an increased number of the terminal members without changing its outer dimensions, that is, to narrow a pitch between each two adjacent terminal members. Needless to say, the terminal members are required to be fixed with sufficient strength.

2. Description of the Related Art

FIG. 1 shows a conventional card edge connector device 10. The card edge connector device 10 includes a housing 20 and a plurality of terminal members 30 fixedly inserted side by side in a row into the housing 20. X1-X2 represents the longitudinal dimension, Y1-Y2 represents the rear-and-front dimension and Z1-Z2 represents the vertical dimension, respectively, of the card edge connector device 10.

As shown in FIGS. 2 through 4, the housing 20, which is formed of an electrically insulating synthetic resin, is shaped like a rectangular solid. On the front (Y2) side, the housing 20 includes a card edge insertion slot 21 into which an edge 41 of a card 40 is inserted, and on the rear (Y1) side, a plurality of slits 22 arranged side by side in a row along the longitudinal (X1-X2) length of the housing 20. Each two adjacent slits 22 have a pitch P1 therebetween. Each of the slits 22 has a shape corresponding to that of each of the terminal members 30, and includes a hole-like slit portion 22*a* as shown in FIGS. 2 and 4.

Each of the terminal members 30 includes a connection terminal portion 31 of a fork-like shape for receiving a card edge, a mounting terminal portion 32 and an arm portion 33.

As indicated by an arrow A in FIG. 2, the terminal members 30 are incorporated into the housing 20 with the connection terminal portions 31 being inserted into the slits 22 from the rear side of the housing 20 so that the arm portions 33 are fixedly pressed into the hole-like slit portions 22*a*. According to this structure, each two adjacent terminal members 30 have the pitch P1 therebetween as shown in FIG. 4.

The card edge connector device 10 having the above-described structure is mounted on a circuit board 50 with the mounting terminal portions 32 soldered thereto. The card 40 includes the edge 41 on which terminals 42 are arranged in a row. The edge 41 of the card 40 is inserted into the card edge insertion slot 21 to be connected to the card edge connector device 10.

According to the above-described card edge connector device 10, all of the terminal members 30 are incorporated into the housing 20 from the same side, that is, from its rear side. Therefore, all of the hole-like slit portions 22*a* are formed on the rear side of the housing 20. As a result, positions 60 at which the arm portions 33 are fixed are arranged side by side in a row in the housing 20 along the X1-X2 direction.

In order that the arm portions 33 can be fixedly pressed into the hole-like slit portions 22*a*, it is necessary to prevent a wall portion 23 formed between each two adjacent hole-like slit portions 22*a* from being broken when the arm portions 33 are pressed into the hole-like slit portions 22*a*. This is because breakages of the wall portions 23 weaken the forces of the hole-like slit portions 22*a* to lock the arm portions 33. For the convenience of graphical representation, the thickness of the wall portion 23 is shown considerably thicker in FIG. 4 than it really is.

According to the above-described conventional card edge connector device 10, each of the wall portions 23 is formed to have a thickness t1 so as not to be broken when the arm portions 33 are pressed into the hole-like slit portions 22*a*, and the pitch P1 between each two adjacent terminal members 30 is determined by the thickness t1 of each of the wall portions 23. Therefore, it is difficult to further narrow the pitch P1 between each two adjacent terminal members 30.

SUMMARY OF THE INVENTION

It is a general object of the present invention to provide a connector device in which the above disadvantages are eliminated.

A more specific object of the present invention is to provide a connector device including a narrowed pitch between each two adjacent terminal members.

The above objects of the present invention are achieved by a connector device including a housing including first and second sides opposing each other, first terminal members attached to the first side of the housing, and second terminal members attached to the second side of the housing, wherein each of the first terminal members and each of the second terminal members are alternately arranged side by side, and the first and second terminal members have respective contact portions for external connection, the contact portions being arranged side by side.

According to the above-described structure, the connector apparatus is allowed to include a narrower pitch between each two adjacent terminal members. Therefore, the connector apparatus can hold an increased number of the terminal members without changing its outer dimensions.

The above objects of the present invention are also achieved by a connector device including a housing including first and second sides opposing each other, first terminal members attached to the first side of the housing, and second terminal members attached to the second side of the housing, wherein each of the first terminal members and each of the second terminal members are alternately arranged side by side, and each of the first and second terminal members has first and second contact portions for external connection, the first contact portions of said first and second terminal members being alternately arranged side by side.

The above objects of the present invention are further achieved by a connector device including: a housing including first and second sides opposing each other; first slits which include respective first slit portions and are formed in the housing from the first side thereof; second slits which include respective second slit portions and are formed in the housing from the second side thereof; first terminal members which include respective first connection terminal portions, first mounting terminal portions and first arm portions and are inserted into the respective first slits with the respective first arm portions being fixedly pressed into the respective first slit portions; and second terminal members which include respective second connection terminal portions, second mounting terminal portions and second arm portions and are inserted into the respective second slits with the respective second arm portions being fixedly pressed into the respective second slit portions, wherein each of the first slits and each of the second slits are alternately arranged side by side so that each of the first slit portions and each of the second slit portions are alternately arranged in a staggered fashion, and each of the first terminal members and each of the second terminal members are alternately arranged side by side in a row in said housing so that each of positions a t which said respective first arm portions are fixed and each of positions at which said respective second arm portions are fixed are arranged in the staggered fashion.

BRIEF DESCRIPTION OF THE DRAWINGS

Other objects, features and advantages of the present invention will become more apparent from the following detailed description when read in conjunction with the accompanying drawings, in which.

DETAILED DESCRIPTION OF THE PREFERRED EMBODIMENTS

A description will now be given, with reference to the accompanying drawings, of an embodiment of the present invention.

Figure 5:
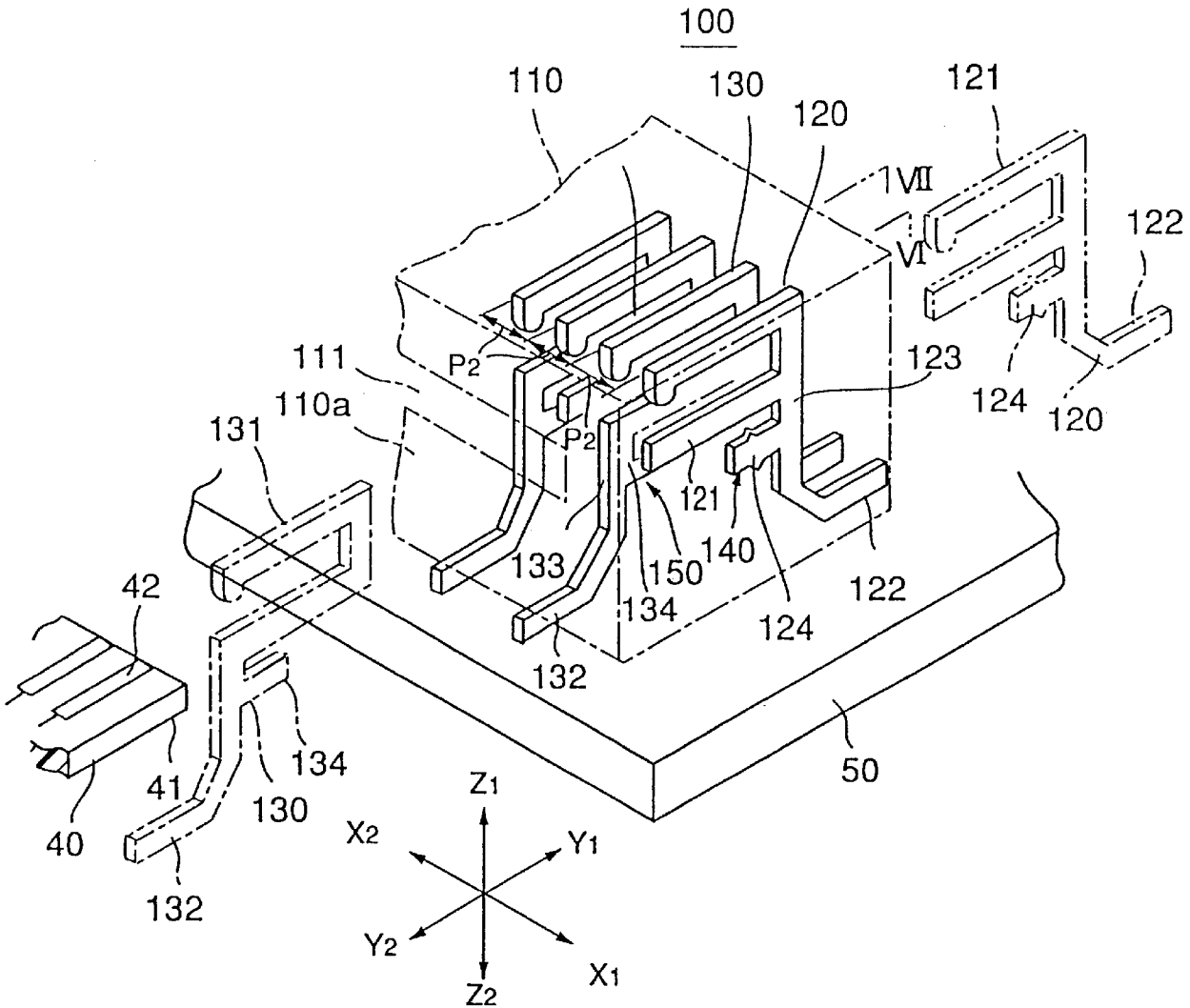
FIG. 5 is a perspective view of a card edge connector device according to an embodiment of the present invention.

FIG. 5 shows a card edge connector device 100 according to the embodiment of the present invention. As also shown in FIGS. 6A through 7B, the card edge connector device 100 includes a housing 110 and a plurality of terminal members 120 inserted from a rear (Y1) side 110*b* of the housing 110 (hereinafter, rear terminal members) and terminal members 130 inserted from a front (Y2) side 110*a* of the housing 110 (hereinafter, front terminal members) fixedly inserted into the housing 110. The rear and front terminal members 120 and 130 are alternately arranged side by side in a row so that one of the rear terminal members 120 and one of the front terminal members 130, which are adjacent to each other, have a pitch P2 therebetween. X1-X2 represents the longitudinal dimension, Y1-Y2 represents the rear-and-front dimension and Z1-Z2 represents the vertical dimension, respectively, of the card edge connector device 100.

As shown in FIGS. 6A through 12, the housing 110 formed of an electrically-insulating synthetic resin is shaped like a rectangular solid. On the front side 110*a*, the housing 110 includes a card edge insertion slot 111 extending along its longitudinal (X1-X2) length. The edge 41 of the card 40 is inserted into the card edge insertion slot 111. On the rear side 110*b*, the housing 110 includes a plurality of rear-side slits 112 arranged side by side in a row along the longitudinal length of the housing 110. The rear terminal members 120 are inserted into the rear-side slits 112. Further, on the front side 110*a*, the housing 110 includes a plurality of front-side slits 113 arranged side by side in a row along the longitudinal length of the housing 110. The front terminal members 130 are inserted into the front-side slits 113.

Figure 12:
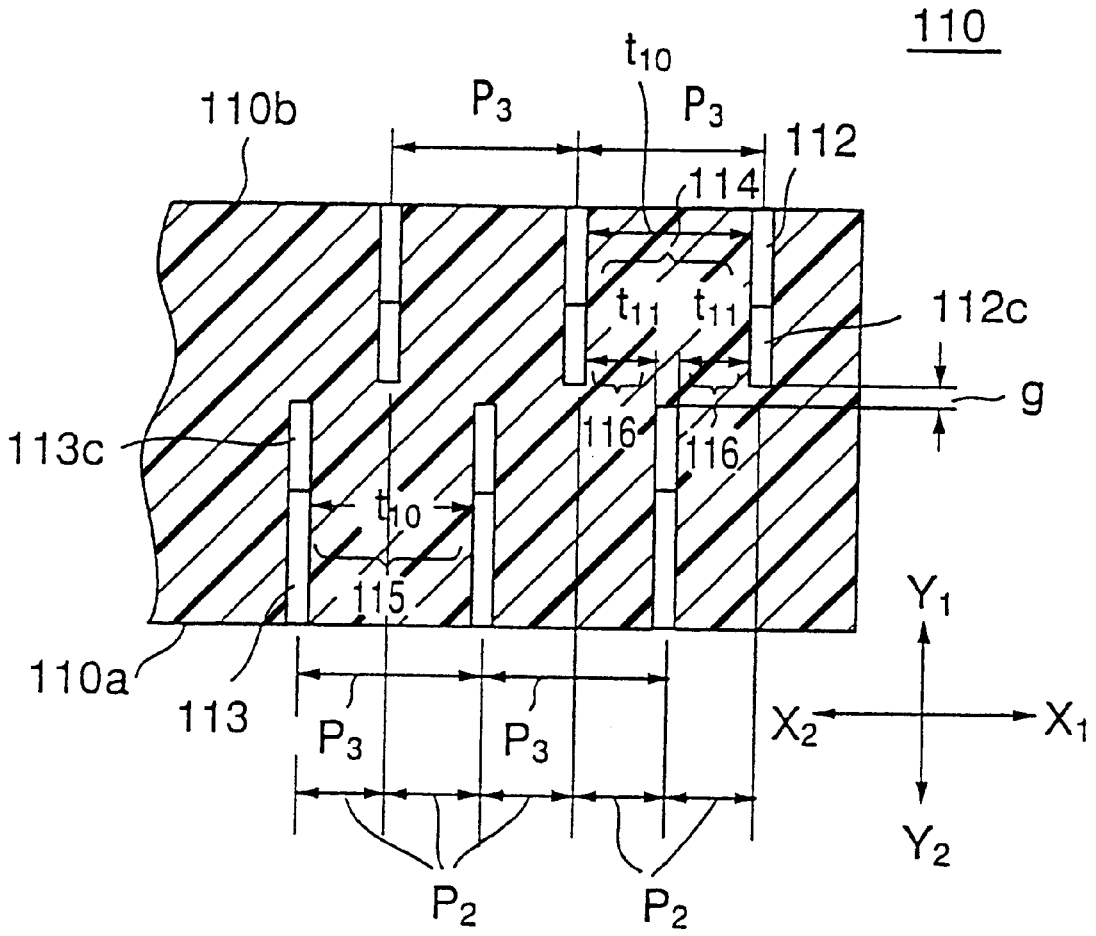
FIG. 12 is a horizontal sectional view of the card edge connector device shown in FIGS. 10A and 10B taken along an X-Y plane XII.

As shown in FIG. 12, the rear-side and front-side slits 112 and 113 are alternately arranged so that each two adjacent rear-side slits 112 are equally arranged with a pitch P3 therebetween, and each two adjacent front-side slits 113 are also arranged with the pitch P3 therebetween. In other words, one of the rear-side slits 112 and one of the front-side slits 113, which are adjacent to each other in a staggered fashion, are arranged with a pitch P2 which is half of the above-described pitch P3.

Figure 8:
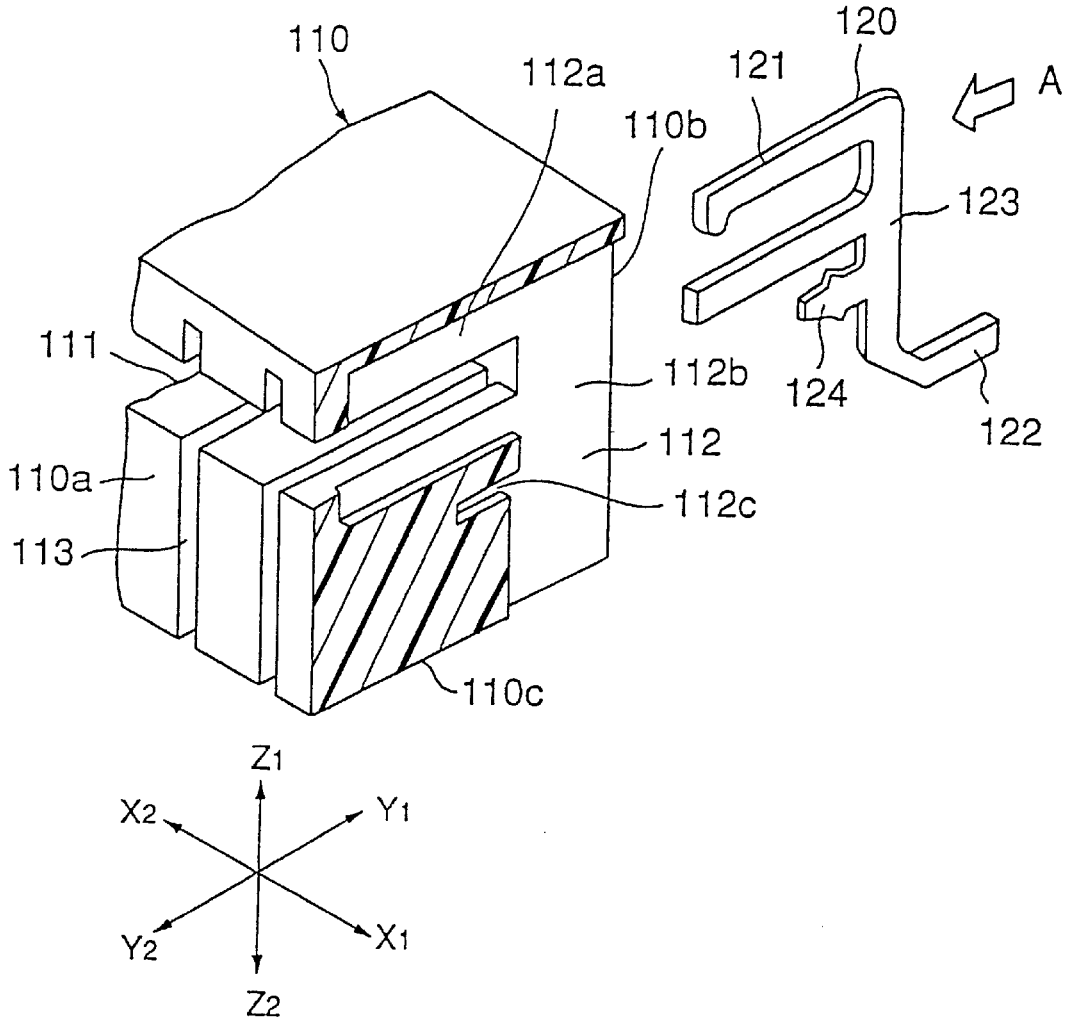
FIG. 8 is a diagram showing a rear terminal member and a housing of the card edge connector device shown in FIGS. 6A and 6B.
Figure 9:
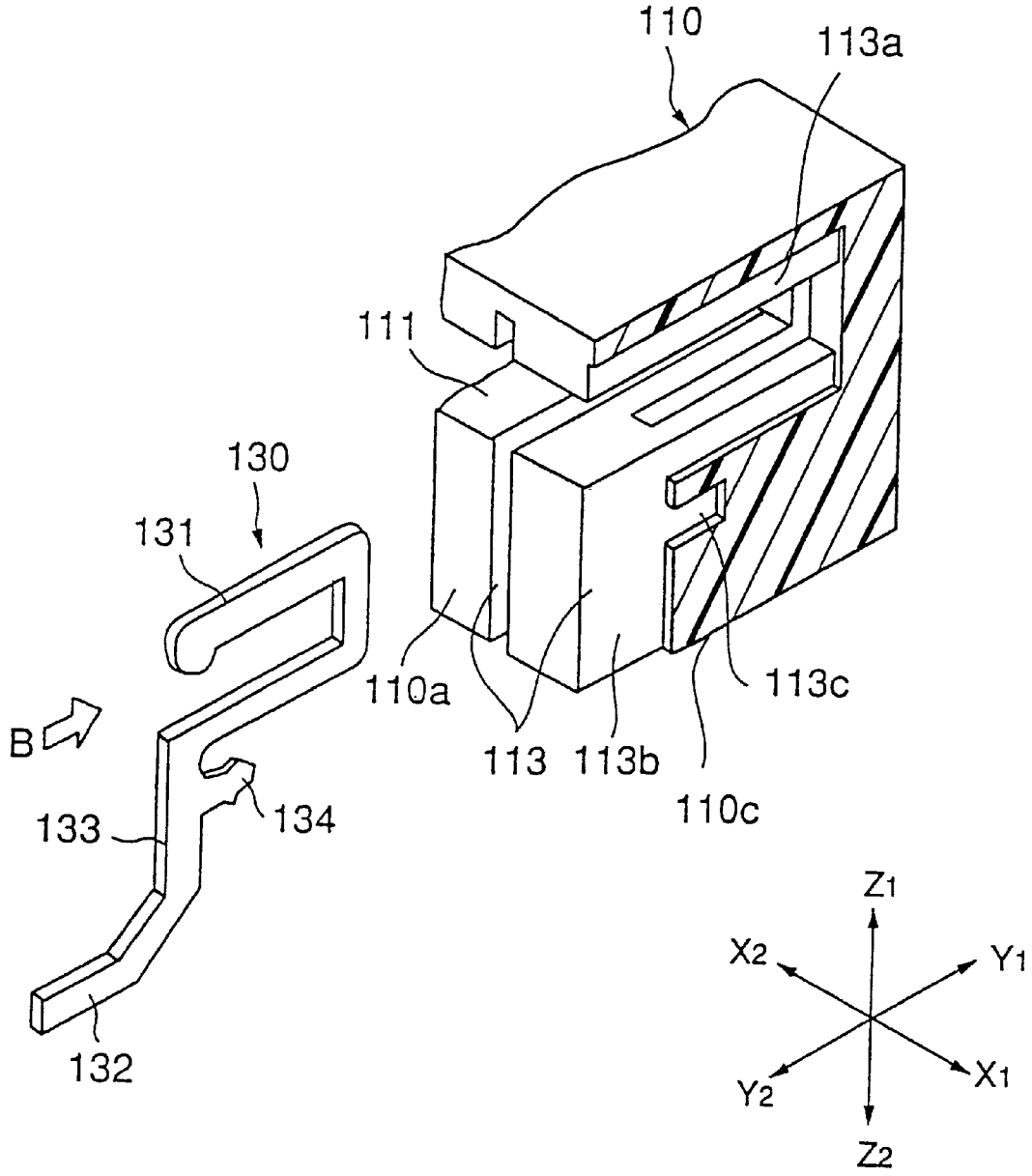
FIG. 9 is a diagram showing a front terminal member and the housing of the card edge connector device shown in FIGS. 7A and 7B.
Figure 10A:
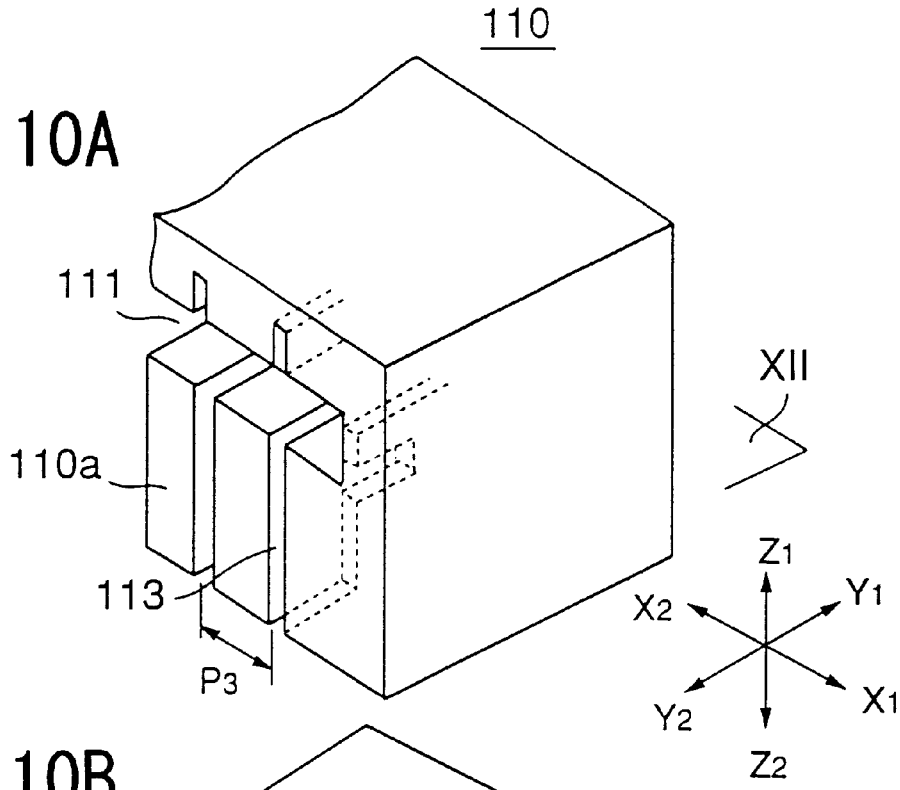
FIGS. 10A and 10B are perspective views of the housing of the card edge connector device of FIG. 5 taken from its front and rear sides, respectively.
Figure 10B:
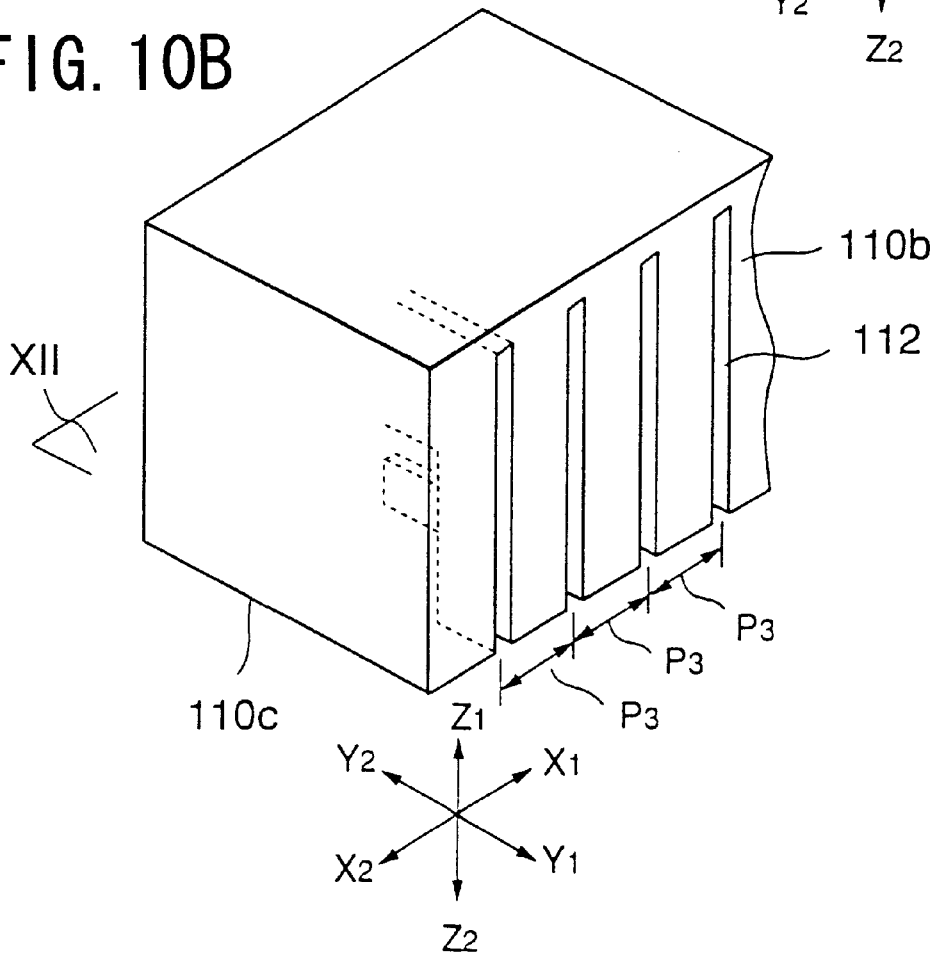
Figure 11:
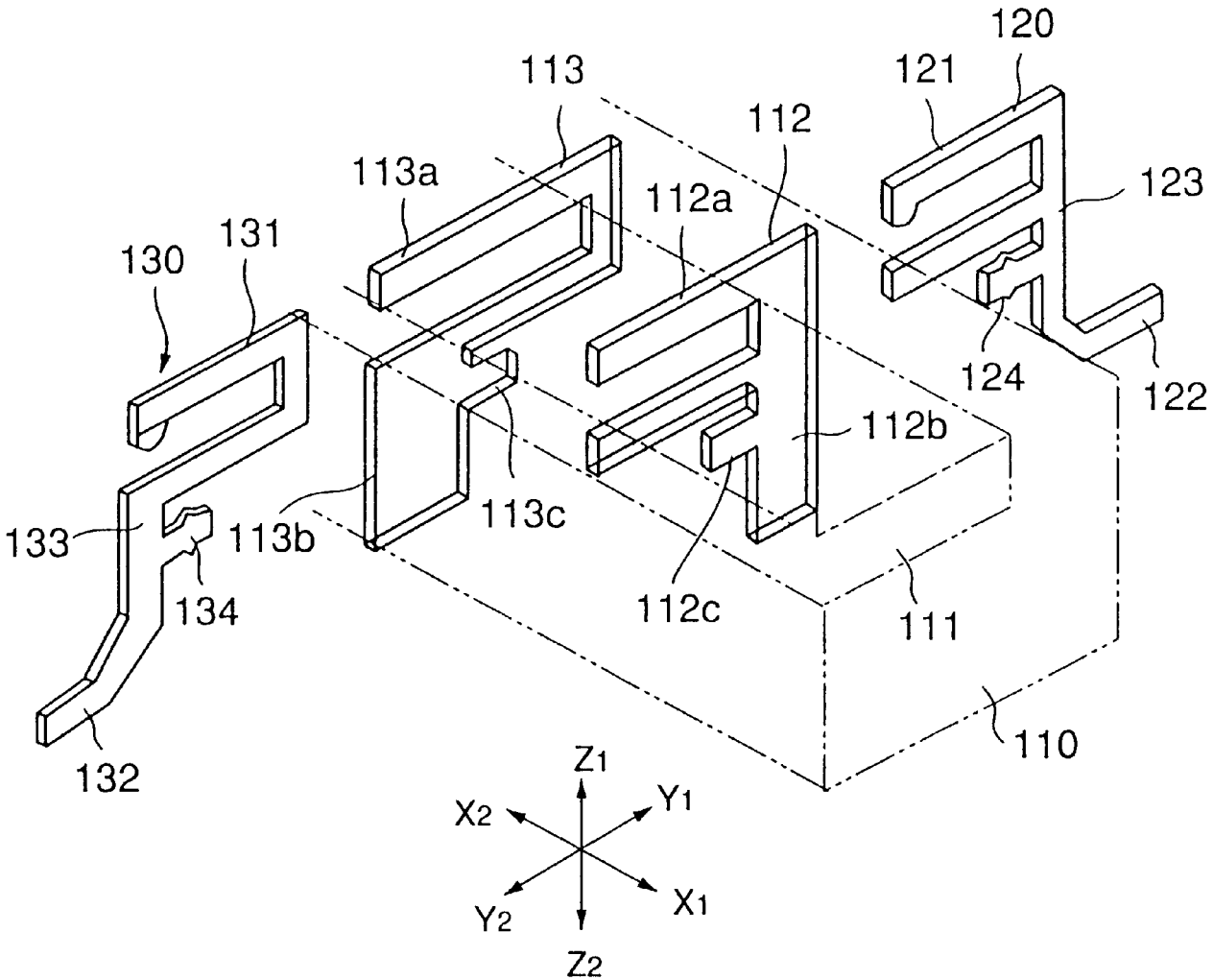
FIG. 11 shows rear and front slits of the housing of the card edge connector device of FIG. 5 and rear and front terminal members corresponding to the rear and front slits, respectively.

As shown in FIGS. 8, 9 and 11, each of the rear-side slits 112 has a shape corresponding to that of each of the rear terminal members 120, and includes a first rear holding portion 112*a*, a second rear holding portion 112*b* and a rear hole-like slit portion 112*c*. Each of the front-side slits 113 has a shape corresponding to that of each of the front terminal members 130, and includes a first front holding portion 113*a*, a second front holding portion 113*b* and a front hole-like slit portion 113*c*. Each of the first rear and front holding portions 112*a* and 113*a* has an opening in the card edge insertion slot 111 so that the card edge insertion slot 111 has an opening on the front side 110*a* of the housing 110. Each of the second rear holding portions 112*b* has openings on the rear side 110*b* and on a bottom side 110*c*, respectively, of the housing 110. The second front holding portions 113*b* each have openings on the front side 110*a* and on the bottom side 110*c*, respectively, of the housing 110.

As shown in FIGS. 8 and 11, each of the rear terminal members 120 has a rear connection terminal portion 121 of a fork-like shape for receiving a card edge, a rear mounting terminal portion 122, a rear post portion 123 formed between the rear connection terminal portion 121 and the rear mounting terminal portion 122, and a rear arm portion 124 protruding in the Y2 direction from the rear post portion 123.

As shown in FIGS. 9 and 11, each of the front terminal members 130 has a front connection terminal portion 131 of a fork-like shape for receiving a card edge, a front mounting terminal portion 132, a front post portion 133 formed between the front connection terminal portion 131 and the front mounting terminal portion 132, and a front arm portion 134 protruding in the Y1 direction from the front post portion 133.

Figure 6A:
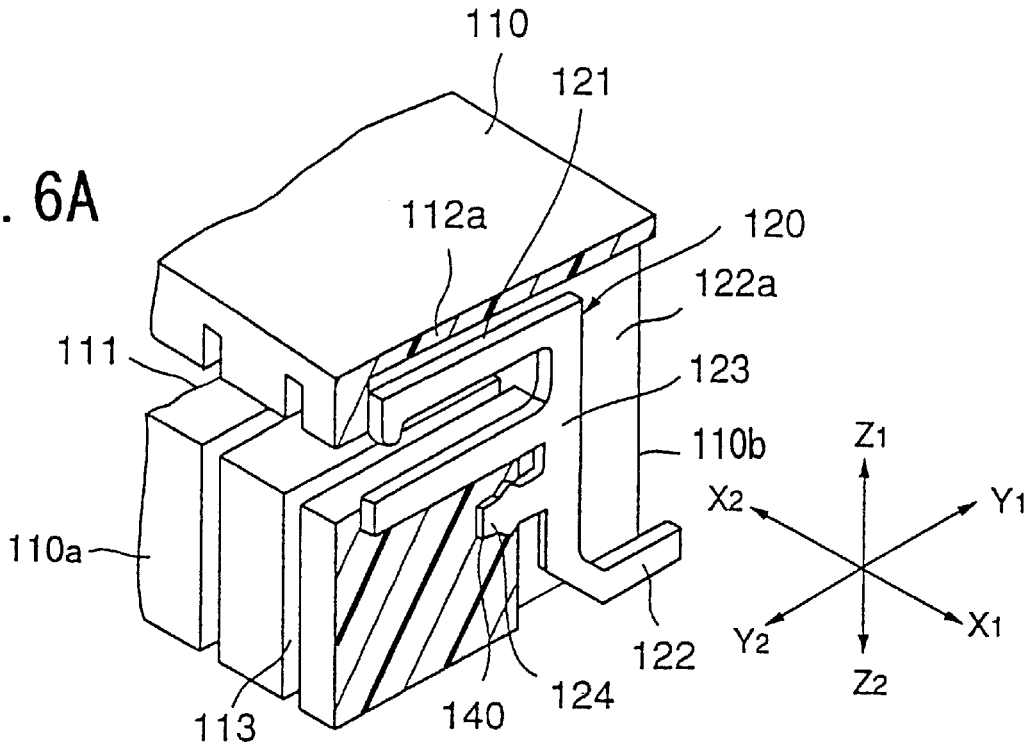
FIGS. 6A and 6B are a perspective cross-sectional view and a sectional side elevation view, respectively, of the card edge connector device of FIG. 5 taken along a Y-Z plane VI.
Figure 6B:
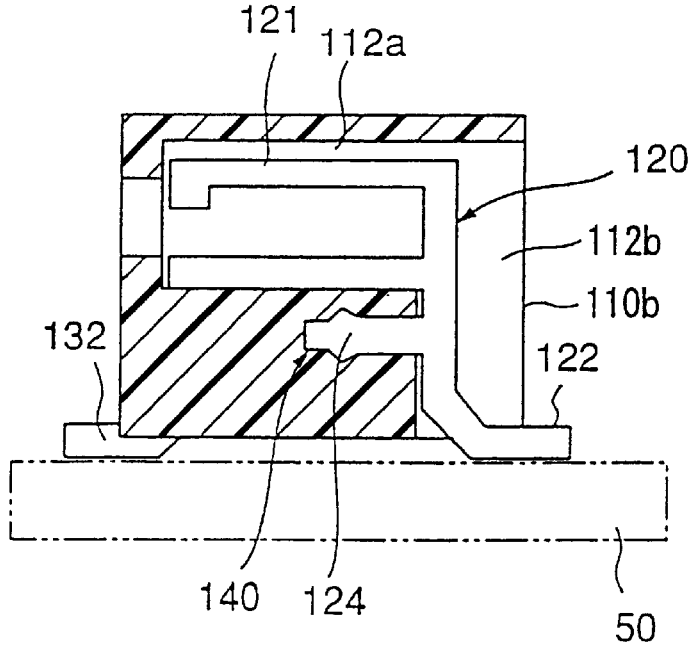

As indicated by an arrow A in FIG. 8, the rear terminal members 120 are fixed in the housing 110 with the rear connection terminal portions 121 being inserted into the rear-side slits 112 from the rear side 110*b* of the housing 110 so that the rear arm portions 124 are pressed into the rear hole-like slit portions 112*c* as shown in FIGS. 6A and 6B. The rear connection terminal portions 121 are held in the first rear holding portions 112*a* so as to be exposed to the card edge insertion slot 111. The rear post portions 123 are held in the second rear holding portions 112*b*, and the rear mounting terminal portions 122 protrude in the Y1 direction from the bottom side 110*c* of the housing 110.

Figure 7A:
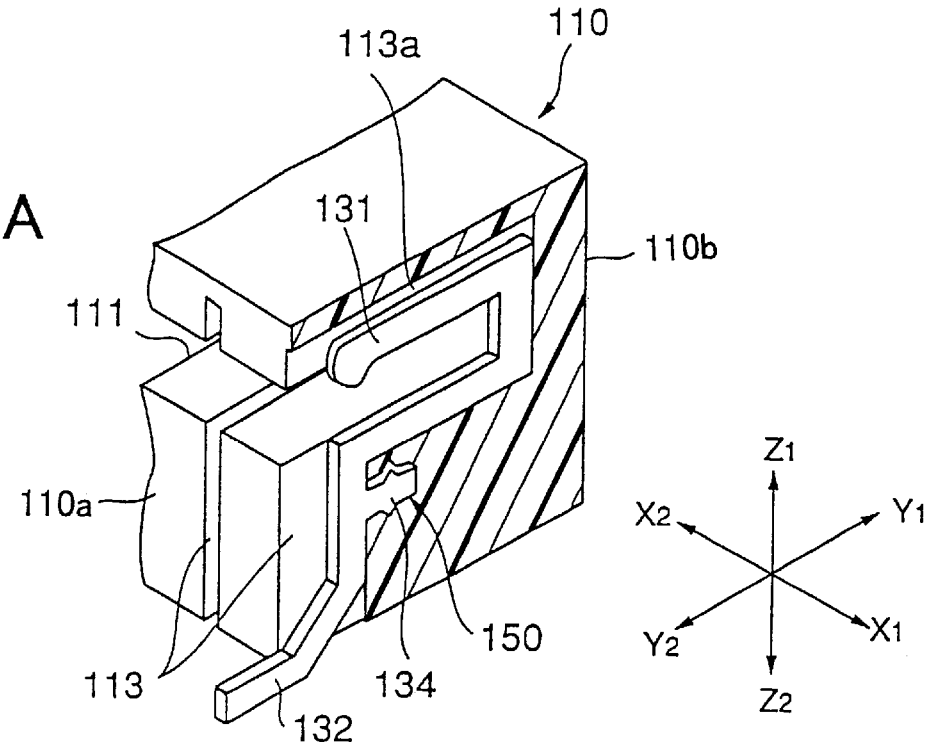
FIGS. 7A and 7B are a perspective cross-sectional view and a sectional side elevation view, respectively, of the card edge connector device of FIG. 5 taken along a Y-Z plane VII.
Figure 7B:
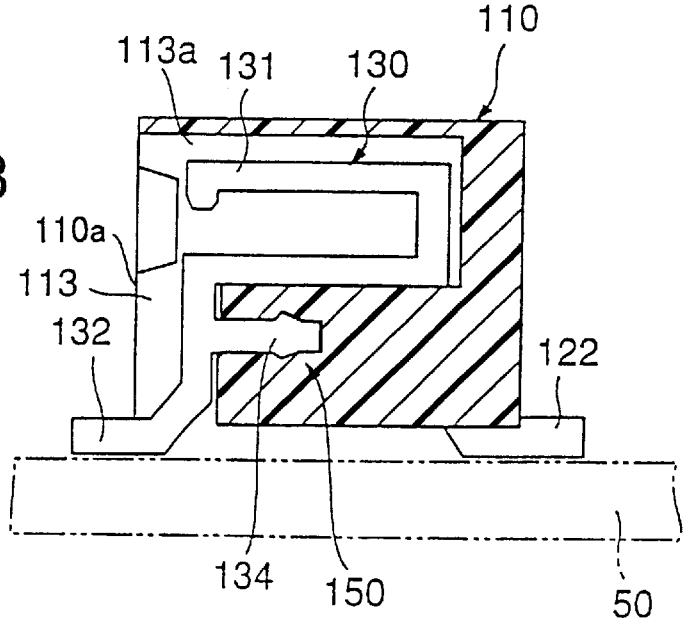

As indicated by an arrow B in FIG. 9, the front terminal members 130 are fixed in the housing 110 with the front connection terminal portions 131 being inserted into the front-side slits 113 from the front side 110*a* of the housing 110 so that the front arm portions 134 are pressed into the front hole-like slit portions 113*c* as shown in FIGS. 7A and 7B. The front connection terminal portions 131 are held in the first front holding portions 113*a* so as to be exposed to the card edge insertion slot 111. The front post portions 133 are held in the second front holding portions 113*b*, and the front mounting terminal portions 132 protrude in the Y2 direction from the bottom side 110*c* of the housing 110.

According to the card edge connector device 100, the rear and front terminal members 120 and 130 are alternately arranged side by side in a row with the pitch P2 between each two adjacent rear and front terminal members 120 and 130. Positions 140 at which the rear arm portions 124 are fixed and positions 150 at which the front arm portions 134 are fixed are alternately arranged in a staggered fashion along the longitudinal length of the housing 110.

According to this embodiment, the positions 140 and 150 are alternately arranged in a horizontally staggered fashion because a first distance from the bottom side 110*c* to each of the rear hole-like slit portions 112*a* is equal to a second distance from the bottom side 110*c* to each of the front hole-like slit portions 113*a*. However, the first distance does not have to be equal to the second distance. In such a case, the positions 140 and 150 are alternately arranged in a vertically staggered fashion.

As shown in FIGS. 5, 6B and 7B, the card edge connector device 100 having the above-described structure is mounted on the circuit board 50 with the rear and front mounting terminals 122 and 132 being soldered thereto. As the rear and front mounting terminals 122 and 132 are arranged in different rows so as to have wider pitches between each two adjacent rear mounting terminals 122 and between each two adjacent front mounting terminals 32, respectively, the rear and front mounting terminals can be soldered easily to the circuit board 50. The card 40 includes the edge 41 on which the terminals 42 are arranged in a row. The edge 41 of the card 40 is inserted into the card edge insertion slot 111 so as to be connected to the card edge connector device 100.

Now, a description will again be given of the characteristics of the above-described card edge connector device 100.

1. Narrower Pitches:

As shown in FIG. 12, in the housing 110, the rear and front hole-like slit portions 112*c* and 113*c* are alternately arranged in the staggered fashion along the longitudinal (X1-X2) length of the card edge connector device 100. Therefore, a rear wall portion 114 formed between each two adjacent rear hole-like slit portions 112*c* on the rear side 110*b* of the housing 110 has a sufficient thickness t10. Likewise, a front wall portion 115 formed between each two adjacent front hole-like slit portions 113*c* on the front side 110*a* of the housing 110 also has the sufficient thickness t10. The thickness t10 of each of the rear and front wall portions 114 and 115 is thicker than the thickness t1 of each of the wall portions 23 of FIG. 4.

The rear and front hole-like slit portions 112*c* and 113*c* are alternately arranged in the staggered fashion along the longitudinal (X1-X2) length of the card edge connector device 100 so as to have a distance g in the rear-and-front (Y1-Y2) dimension of the card edge connector device 100 between the bottom portions of each of the rear hole-like slit portions 112*c* and each of the front hole-like slit portions 113*c* when viewing the Y-Z plane. In other words, the rear and front hole-like slit portions 112*c* and 113*c* do not overlap each other when viewing the Y-Z plane. Therefore, expansive deformations of the rear hole-like slit portions 112*c* caused by pressing the rear arm portions 124 thereinto do not easily affect the respective front hole-like slit portions 113*c* adjacent to the respective rear hole-like slit portions 112*c* in the staggered fashion. Likewise, the expansive deformations of the front hole-like slit portions 113*c* caused by pressing the front arm portions 134 thereinto do not easily affect the respective rear hole-like slit portions 112*c* adjacent to the respective front hole-like slit portions 113*c* in the staggered fashion. Thus, the thickness of a wall portion 116 formed between each of the rear hole-like slit portions 112*c* and each of the front hole-like slit portions 113*c* has a thickness t11 which is thinner than the thickness t1 of each of the wall portions 23 in FIG. 4 when viewing the X-Z plane.

When the rear arm portions 124 are pressed into the rear hole-like slit portions 112*c*, the wall portions 116 as well as the wall portions 114 are prevented from being broken. Similarly, when the front arm portions 134 are pressed into the front hole-like slit portions 113*c*, the wall portions 116 as well as the wall portions 115 are prevented from being broken. Therefore, the rear and front terminal members 120 and 130 are firmly fixed.

Figure 1:
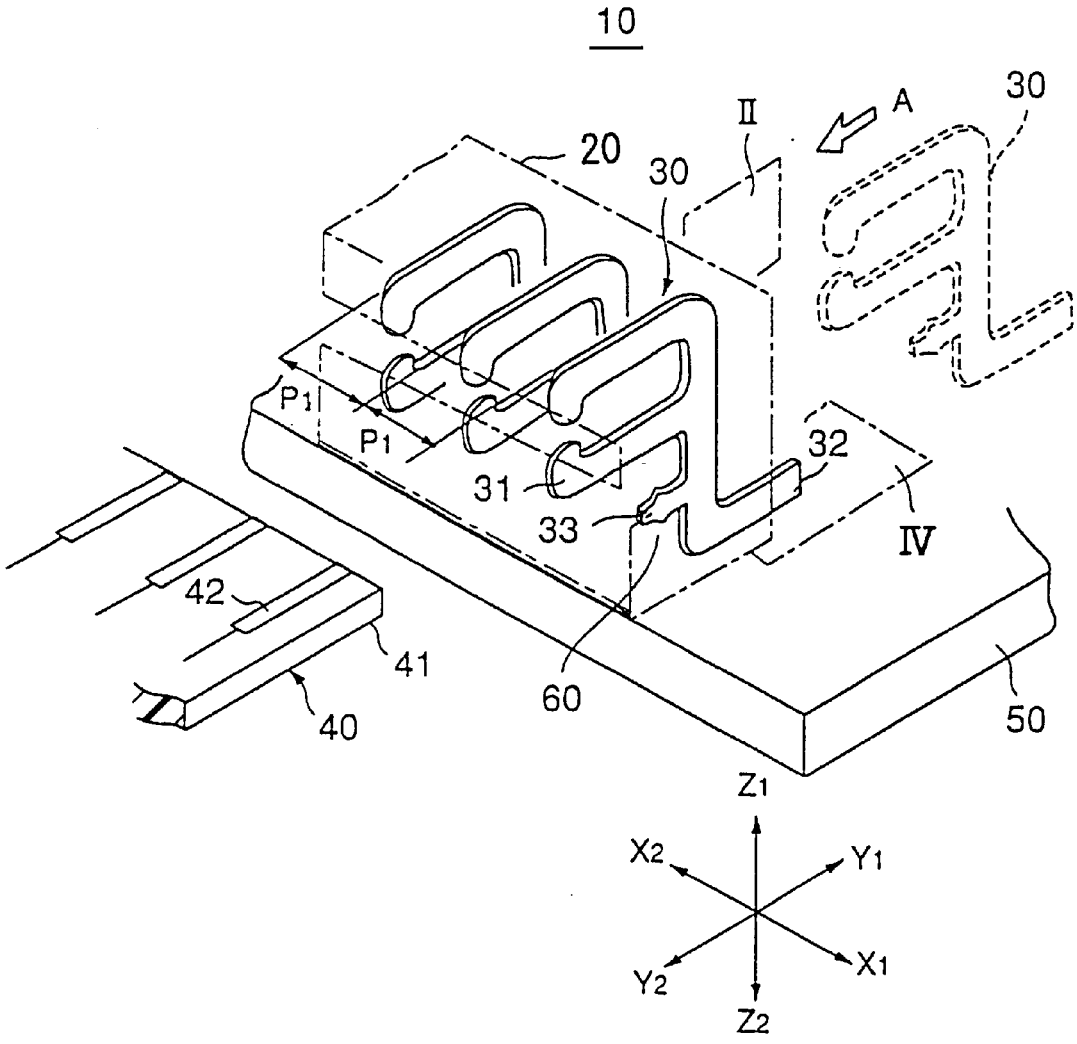
FIG. 1 PRIOR ART
FIG. 1 is a perspective view of a conventional card edge connector device.
Figure 2:
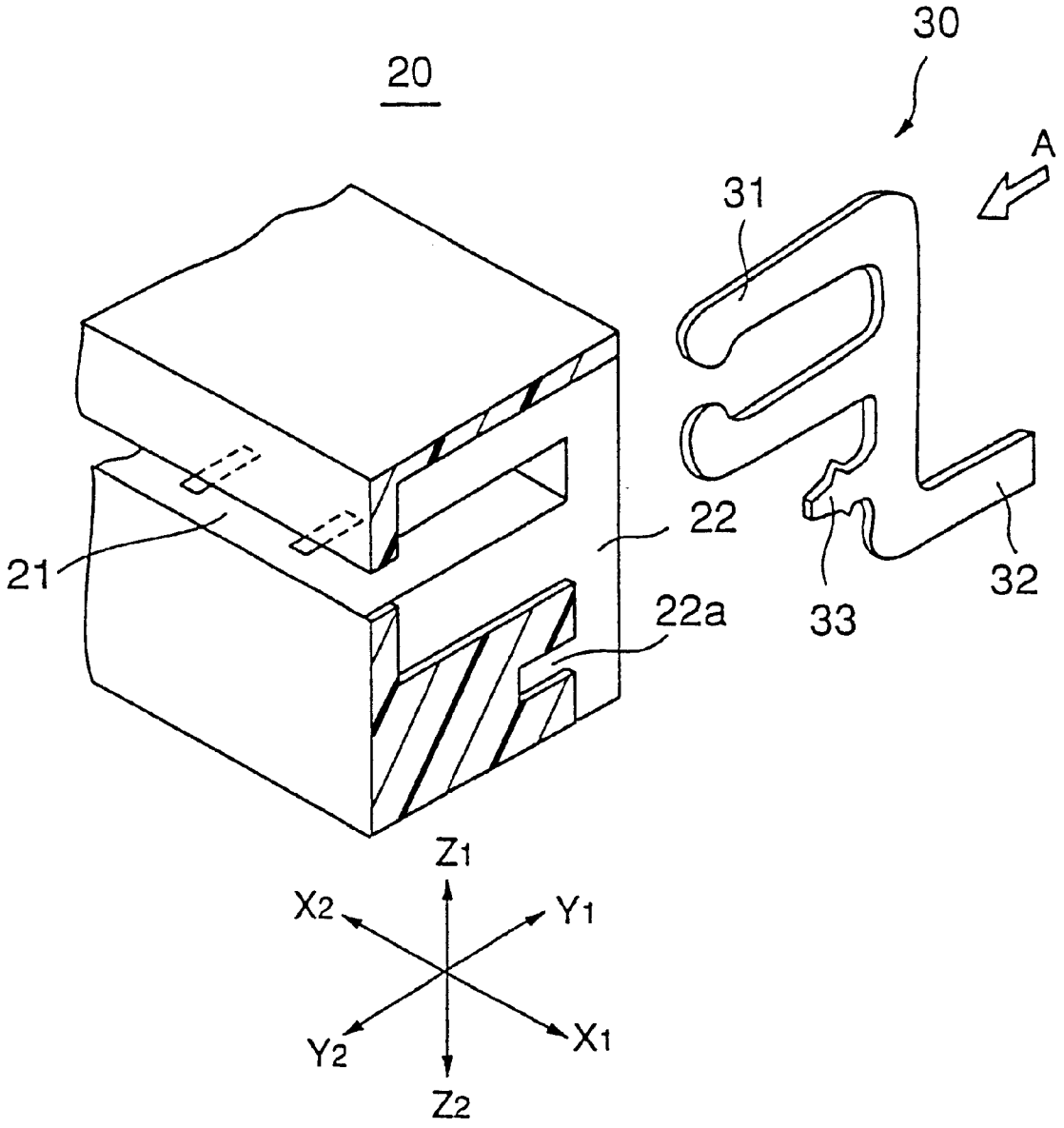
FIG. 2 PRIOR ART
FIG. 2 shows a terminal member and a housing of the conventional card edge connector device of FIG. 1, the housing being cut off by a Y-Z plane II.
Figure 3:
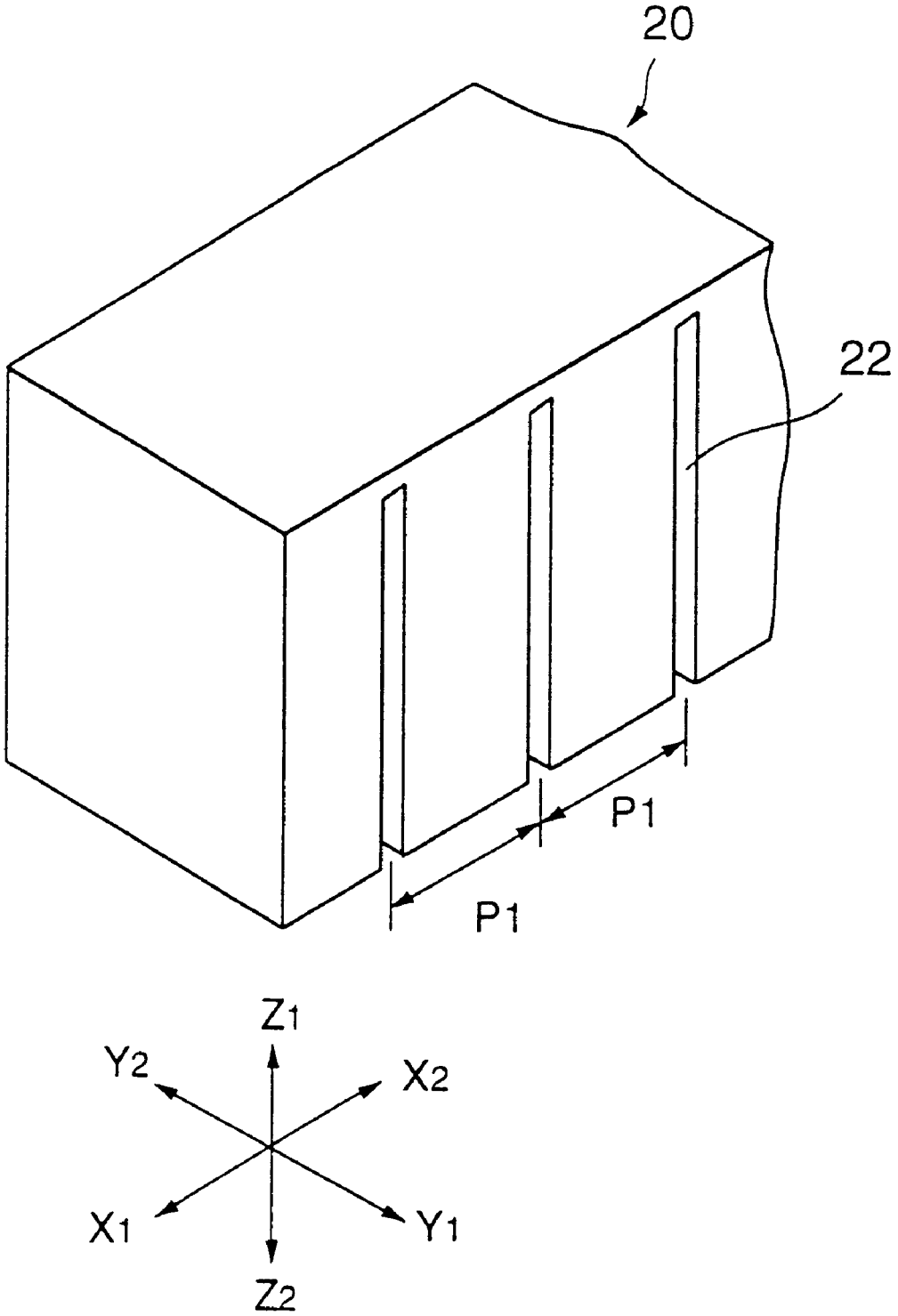
FIG. 3 PRIOR ART
FIG. 3 is a perspective view of the housing of the conventional card edge connector device of FIG. 1 taken from its rear side.
Figure 4:
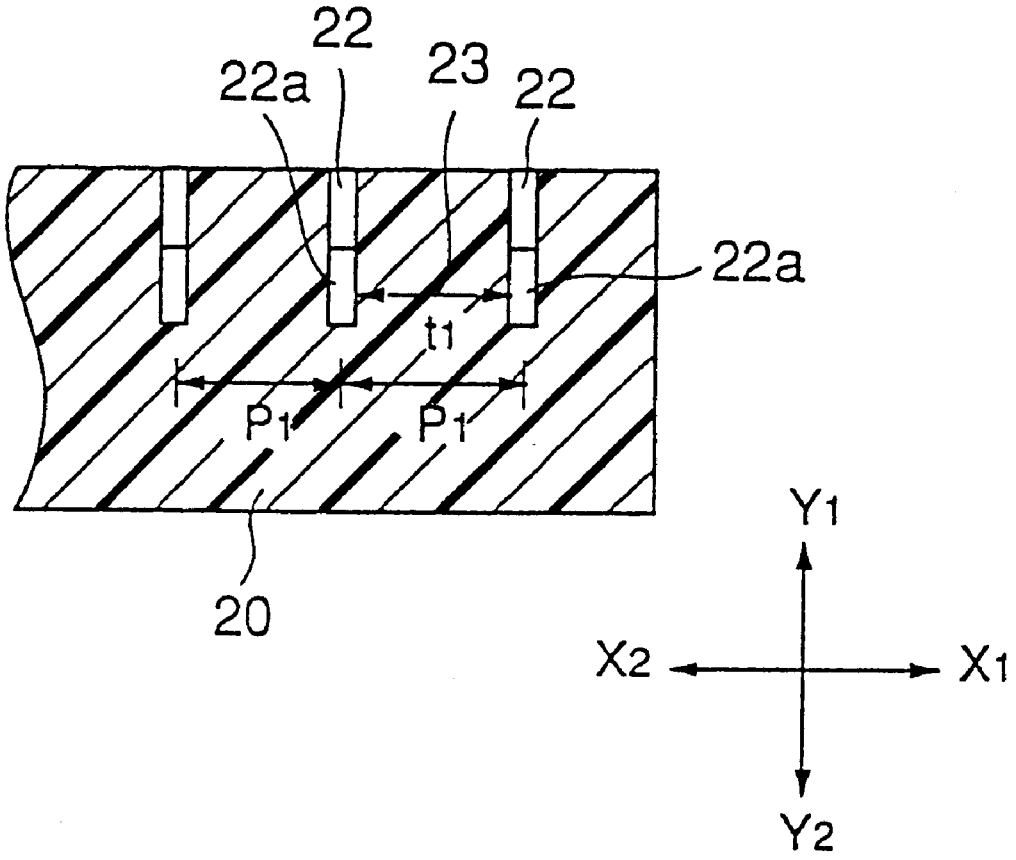
FIG. 4 PRIOR ART
FIG. 4 is a horizontal sectional view of the housing of the conventional card edge connector device of FIG. 1 taken along an X-Y plane IV.

According to the card edge connector device 100, as the wall portions 116 each have the thickness t11 which is thinner than the thickness t1 of each of the wall portions 23 of FIG. 4, the rear and front terminal members 120 and 130 are alternately arranged so that each adjacent two thereof have therebetween the pitch P2 which is narrower than the pitch P1 with which each two adjacent terminal members 30 of the card edge connector 10 are arranged.

In FIG. 12, for the convenience of graphical representation, the thickness t10 of each of the wall portions 114 and 115, the thickness t11 of each of the wall portions 116 and so on are shown enlarged compared with the real dimensions thereof. Further, the rear and front hole-like slit portions 112*c* and 113*c* can be alternately arranged in the staggered fashion along the longitudinal (X1-X2) length of the card edge connector device 100 so as to have no distance in the rear-and-front (Y1-Y2) dimension of the card edge connector device 100 between the bottom portions of each of the rear hole-like slit portions 112*c* and each of the front hole-like slit portions 113*c* when viewing the Y-Z plane.

Figure 13A:
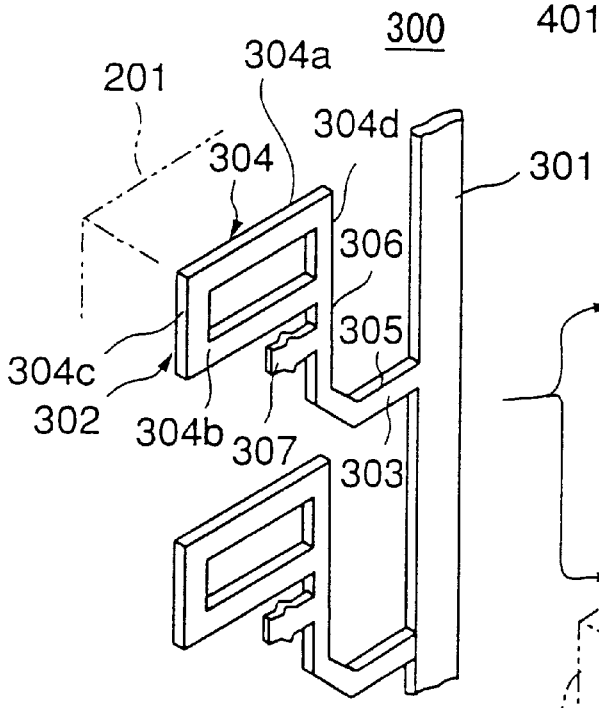
FIGS. 13A through 13C are diagrams for illustrating a production process of the rear and front terminal members.
Figure 13B:
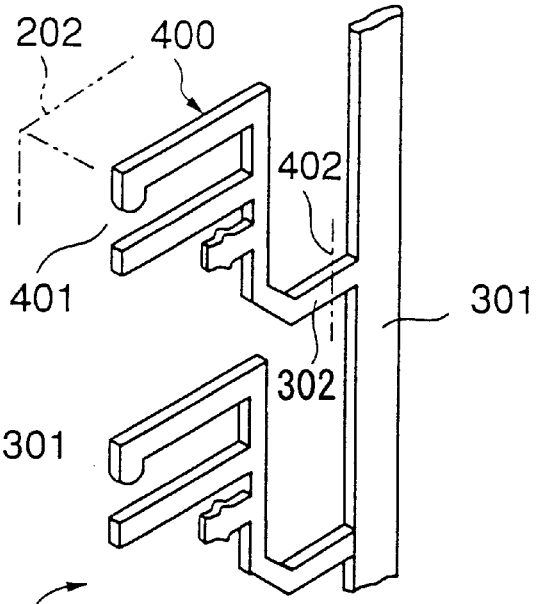
Figure 13C:
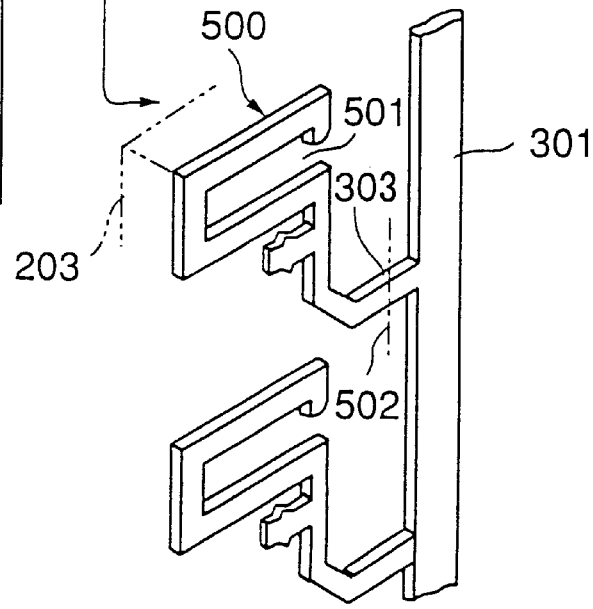

2. Reduction of the Production Cost of the Rear and Front Terminal Members 120 and 130:

The rear and front terminal members 120 and 130 shown in FIGS. 8 and 9, respectively, are produced in a production process illustrated by FIGS. 13A through 13C.

First, a primary workpiece 300 shown in FIG. 13A is stamped out of a metal strip by means of a first press die 201.

The primary workpiece 300 includes a bridge 301, a plurality of first patterns 302 and a plurality of connection arm portions 303 connecting the bridge 301 and the first patterns 302. Each of the first patterns 302 includes a frame portion 304 of a rectangular shape, a mounting terminal portion 305, a post portion 306 connecting the frame portion 304 and the mounting terminal portion 305, and an arm portion 307 protruding from the post portion 306. In FIG. 13A, the frame portion 304 includes upper and lower longitudinal portions 304*a* and 304*b* and first and second side portions 304*c* and 304*d*.

Next, the primary workpiece 300 is set in a second press die 202 as shown in FIG. 13B to have the center portions of the first side portions 304*c* cut off, so that a plurality of first secondary workpieces 400 each having the frame portion 304 formed into a fork-like shape are obtained. A numeral 401 indicates one of the cut-off portions. Finally, each of the first secondary workpieces 400 is cut off at the arm portion 303 along a line 402. Thus, each of the rear terminal members 120 shown in FIG. 8 is produced.

Further, the primary workpiece 300 is set in a third press die 203 as shown in FIG. 13C to have the center portions of the second side portions 304*d* cut off, so that a plurality of second secondary workpieces 500 each having the frame portion 304 formed into a fork-like shape are obtained. A numeral 501 indicates one of the cut-off portions. Finally, each of the second secondary workpieces 500 is cut off at the arm portion 303 along a line 502. Thus, each of the front terminal members 130 shown in FIG. 9 is produced.

As described above, the primary workpiece 300 is common to both of the rear and front terminal members 120 and 130. The rear and front terminal members 120 and 130 are formed by cutting off the center portions of the first and second side portions 304*c* and 304*d*, respectively. In other words, the rear and front terminal members 120 and 130 are allowed to share the primary workpiece 300 by forming each of the first patterns 302 of the primary workpiece 300 to have a shape shown in FIG. 13A.

Therefore, the differently-shaped rear and front terminal members 120 and 130 are produced by employing the first, second and third press dies 201, 202 and 203.

If the rear and front terminal members 120 and 130 are independently formed without employing the above-described primary workpiece 300, separate press dies are required to directly stamp out the rear and front terminal members 120 and 130. Both of the press dies for directly stamping out the rear and front terminal members 120 and 130 have complicated shapes and structures, thus turning out to be expensive.

On the other hand, the above-described first press die 201 also has a complicated shape and structure and, therefore, is expensive. However, the second and third press dies 202 and 203 each have a simple shape and structure and, therefore, are inexpensive. Therefore, the costs of preparation for the first, second and third press dies 201, 202 and 203 are lower than those of preparation for the press dies for directly stamping out the rear and front terminal members 120 and 130, thus reducing the production cost of the rear and front terminal members 120 and 130.

The present invention is not limited to the specifically disclosed embodiment, and variations and modifications may be made without departing from the scope of the present invention. For example, the present invention is also applicable to a connector device other than a card edge connector device. Such a connector device includes, instead of a card edge insertion slot as described above, a connection slot into which the connector of a device to be connected is inserted so that the device is connected to the connector device.

The present application is based on Japanese priority application No. 2000-016093 filed on Jan. 25, 2000, the entire contents of which are hereby incorporated by reference.

What is claimed is:

1. A connector device, comprising:

a housing including first and second sides opposing each other;

a plurality of first slits with a first fixing slit formed on the first side;

a plurality of second slits with a second fixing slit formed on the second side;

first terminal members, inserted in one of the plurality of first slits, with a first protruding portion inserted in the first fixing slit on the first side of the housing; and second terminal members, inserted in one of the plurality of second slits, with a second protruding portion inserted in the second fixing slit on the second side of the housing, wherein each of the first terminal members and each of the second terminal members are alternately arranged side by side and the first and second terminal members have an upper contact portion and an under contact portion for external connection, said contact portions being alternately arranged on the first side then on the second side on a level with one another and the first and second terminal members are fixed in the first and second slits respectively by the first and second protruding portions being inserted in the first and second fixing slits.

2. The connector device as claimed in claim 1, wherein a sum of a distance from the first side of the housing to each of bottom portions of the first fixing slits and a distance from the second side to each of bottom portions of the second fixing slits is shorter than a distance between the first and second sides.

3. The connector device as claimed in claim 1, wherein a sum of a distance from the first side of the housing to each of bottom portions of the first fixing slits and a distance from the second side to each of bottom portions of the second fixing slits is equal to a distance between the first and second sides.

4. The connector device as claimed in claim 1, wherein the housing further comprises a slot which the first and second terminal members are arranged around.

5. The connector device as claimed in claim 4, wherein the slot is a card edge insertion slot into which a card edge is inserted for connection.

6. The connector device as claimed in claim 1, wherein each of the first protruding portions and each of the second protruding portions are arranged so that the first and second protruding portions are not on a same horizontal line.

7. The connector apparatus as claimed in claim 6, wherein each of the first protruding portions and each of the second protruding portions are arranged so that the first and second protruding portions are not on a same vertical line.

8. The connector device as claimed in claim 1, wherein each of the first fixing slits and each of the second fixing slits are arranged so that the first and second protruding portions are not on a same horizontal line.

9. The connector device as claimed in claim 8, wherein each of the first slits and each of the second slits are arranged so that the first and second protruding portions are not on a same vertical line.

10. The connector device as claimed in claim 1, wherein the first and second terminal members are stamped out from a metal plate.

11. The connector device as claimed in claim 10, wherein each of the first and second terminal members are formed by cutting off a selected one of two shorter sides of a rectangular frame portion, the shorter sides opposing each other.

12. The connector device as claimed in claim 11, wherein the rectangular frame portion further includes a mounting terminal portion, a post portion, and a protruding portion protruding from the post portion, the post portion connecting the rectangular frame portion and the mounting terminal portion.

13. A connector device comprising:

a housing including first and second sides opposing each other;

a plurality of first slits with a first fixing slit formed on the first side;

a plurality of second slits with a second fixing slit formed on the second side;

first terminal members, inserted in one of the plurality of first slits, with a first protruding portion inserted in the first fixing slit on the first side of the housing; and second terminal members, inserted in one of the plurality of second slits, with a second protruding portion inserted in the second fixing slit on the second side of the housing, wherein each of the first terminal members and each of the second terminal members are alternately arranged on the first side then on the second side and each of the first and second terminal members has a first upper contact portion for external connection and a second under contact portion for mounting, the first contact portions of said first and second terminal members being alternately arranged side by side on a level with one another and the first and second terminal members are fixed in the first and second slits respectively by the first and second protruding portions being inserted in the first and second fixing slits.

14. A connector device, comprising:

a housing including a first side and a second side, the second side opposing the first side;

a plurality of first slits with a first fixing slit formed on the first side;

a plurality of second slits with a second fixing slit formed on the second side;

a plurality of first terminal members, with each having an upper contact portion and an under contact portion, inserted in one of the plurality of first slits, with a first protruding portion inserted in the first fixing slit on the first side of the housing; and a plurality of second terminal members, with each having an upper contact portion and an under contact portion, inserted in one of the plurality of second slits, with a second protruding portion inserted in the second fixing slit on the second side of the housing, wherein each of the first terminal members and each of the second terminal members are alternately arranged side by side, the first and second terminal members are formed from a same pattern and the first and second terminal members are fixed in the first and second slits respectively by the first and second protruding portions being inserted in the first and second fixing slits.

15. A connector device comprising:

a housing including a first side and a second side, the second side opposing the first side;

a plurality of first slits with a first fixing slit formed on the first side;

a plurality of second slits with a second fixing slit formed on the second side;

a plurality of first terminal members, with each having an upper contact portion and an under contact portion, inserted in one of the plurality of first slits, with a first protruding portion inserted in the first fixing slit on the first side of the housing; and a plurality of second terminal members, with each having an upper contact portion and an under contact portion, inserted in one of the plurality of second slits, with a second protruding portion inserted in the second fixing slit on the second side of the housing, wherein each of the first terminal members and each of the second terminal members are alternately arranged side by side, each of the first and second terminal members are formed from a same pattern and the first and second terminal members are fixed in the first and second slits respectively by the first and second protruding portions being inserted in the first and second fixing slits.

* * * * *